United States Patent [19]

Bofinger et al.

[11] Patent Number: 4,615,317

[45] Date of Patent: Oct. 7, 1986

[54] RPM GOVERNOR FOR FUEL INJECTION PUMPS

[75] Inventors: Günter Bofinger, Vaihingen; Claus Maier, Ludwigsburg, both of Fed. Rep. of Germany

[73] Assignee: Robert Bosch GmbH, Stuttgart, Fed. Rep. of Germany

[21] Appl. No.: 729,024

[22] Filed: Apr. 30, 1985

[30] Foreign Application Priority Data

Jul. 13, 1984 [DE] Fed. Rep. of Germany ... 8421006[U]
Jan. 8, 1985 [DE] Fed. Rep. of Germany ..... 3500341

[51] Int. Cl.[4] ..... F02M 39/00

[52] U.S. Cl. ..... 123/373; 123/179 L; 123/449

[58] Field of Search ..... 123/373, 449, 503, 179 L

[56] References Cited

U.S. PATENT DOCUMENTS

| | | | |
|---|---|---|---|
| 3,942,498 | 3/1976 | Eheim | 123/373 |
| 3,945,360 | 3/1976 | Laufer | 123/503 |
| 4,180,040 | 12/1979 | Hofer | 123/503 |
| 4,208,999 | 6/1980 | Konrath | 123/503 |
| 4,438,746 | 3/1984 | Greiner | 123/373 |
| 4,513,715 | 4/1985 | Braun | 123/503 |
| 4,519,352 | 5/1985 | Eheim | 123/373 |

FOREIGN PATENT DOCUMENTS

| | | | |
|---|---|---|---|
| 0152711 | 12/1979 | Japan | 123/449 |
| 2119962 | 11/1983 | United Kingdom | 123/373 |

*Primary Examiner*—Carl Stuart Miller
*Attorney, Agent, or Firm*—Edwin E. Greigg

[57] ABSTRACT

An rpm governor for internal combustion engines having two cooperating levers pivotable about a shaft and engaged at one end by at least one governor spring and, counter to this force, by at least one rpm signal transducer is proposed. An idling spring engages one of the two levers, and its other end is adjustably disposed in the governor housing. As a result, a very fine idling adjustment is attainable, independently of the conventional governor springs, and so a "hole" in the engine torque during a transition from overrunning to loaded operation is avoided.

4 Claims, 6 Drawing Figures

RPM GOVERNOR FOR FUEL INJECTION PUMPS

BACKGROUND OF THE INVENTION

The invention is based on an rpm governor for fuel injection pumps as generally defined hereinafter. In a known rpm governor, or speed governor, of this kind (used in Bosch distributor injection pumps, Type VE), the idling spring is disposed between two levers and arranged parallel to a starting spring, which is likewise disposed between the levers and parallel to the idling spring. The idling spring, embodied as a helical compression spring, does not begin to come into play until the starting lever is pivoted, counter to the force of the starting spring, out of a position corresponding to an increased starting fuel quantity and into the idling position, in order to regulate, or govern, the idling speed during substantially load-free operation. To this end, a certain stroke length is available to the helical compression spring, before the two levers meet with frictional force—for instance when the load is increasing because of an adjustment or tensioning of the main governor spring, as well as when the load or driving resistance is decreasing and the rpm is accordingly increasing—causing the idling spring to be taken out of play for these operating ranges.

Especially when relatively low rpm is to be maintained during idling, the degree of nonuniformity (P-degree: degree of proportionality, or speed droop; the ratio between the increase in rpm from the rated rpm to the upper idling rpm and the upper full-load rpm) of the variation of the injection quantity over the rpm is high, so the differences between the characteristics or parameters affecting the idling rpm have a relatively great effect. Such parameters may be the combustion quality of the fuel and its readiness to ignite as well as frictional forces or tolerances in the pump itself. Frequently tolerances in the spring force of the idling spring, which do not manifest themselves until the pump is in operation, result in great differences in the residual fuel quantity supplied, for example for zero load, especially at the point when the idling spring ceases to be operative, which leads to considerable differences in the operation of a pump with mini-tolerances as opposed to maxi-tolerances. In this known governor, because of the space requirements, it is virtually impossible to adjust the idling spring, and hence the P-degree, retroactively, that is, in the installed state. The idling spring in these known governors is relatively stiff, so that despite the high P-degree a small degree of hysteresis can be attained, which primarily counteracts the jerking or bucking of the engine caused by the variable fuel preparation in the engine cylinders.

A further disadvantage is that in these known governors, there is a "hole" in the engine torque when switching over from overrunning to operation under load, with considerable impairment of the quality of driving, especially when the vehicle involved is a passenger car.

OBJECT AND SUMMARY OF THE INVENTION

The rpm governor for fuel injection pumps according to the invention has the advantage over the prior art that idling can be adjusted both separately and very finely. As a result, a very fine adjustment of the course of the residual quantity in a transitional rpm range, in which range an intermediate spring reduces the degree of nonuniformity in order to attain better engine operation, is made with the aid of this intermediate spring, independently of the governor springs which perform load regulation, particularly at relatively high rpm. Because the idling spring engages one of the governor springs, independently of any other governor springs, only the centrifugal force signal transducer acts as a counterforce upon the idling spring in its assigned rpm range. It is therefore possible to embody the idling spring as quite soft, which brings about a smaller degree of nonuniformity and in particular exerts better control over the quadratic force function of the rpm signal transducer.

Because of the independent arrangement, this idling spring disposed at one end on the pump housing can also assure, for overrunning (load-free operation, in which the vehicle pushes the engine), that a small fuel quantity is always injected; as a result, when a transition is made to operation under load, that is, when "stepping on the gas", there will not be a "hole" in the fuel supply. This "hole" has a particularly unpleasant effect in Diesel engines, because the high compression means that the engine brakes the vehicle correspondingly strongly when fuel is not being supplied.

In accordance with the invention, the governor spring can engage either the first or the second lever; in the case of the second lever, which is also the lever for the increased starting quantity, the governor spring must be allowed to act only until the lever pivots into the position for the increased starting quantity, at which time only the starting spring should be in action.

An advantageous further feature of the invention is the inclusion in the apparatus of a correcting spring which is disposed in series with the idling spring thereby enabling a correction of a disruptive nonuniformity in the course of the injection quantity especially at a very low set rpm in the idling range. Because of the nonlinear course of the operating capacity of the rpm signal transducer at low rpm, especially when a centrifugal force rpm transducer is used, the failure to use the aforesaid correcting spring arrangement would result in an unfavorable nonuniformity degree for operation in the idling range, thereby increasing the tendency of the quantity control to change overly quickly over to the range of the breakaway regulation curve of the starting quantity, where the engine, because of the pronounced steepness of this breakaway regulation curve, starts to vibrate. Such nonuniformity, as well as nonuniformity deriving from other sources, can be compensated for in this range, and the breakaway regulation curve can be linearized with a favorable onset point, yet provisions toward improving the operational capacity of the governor are not required.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
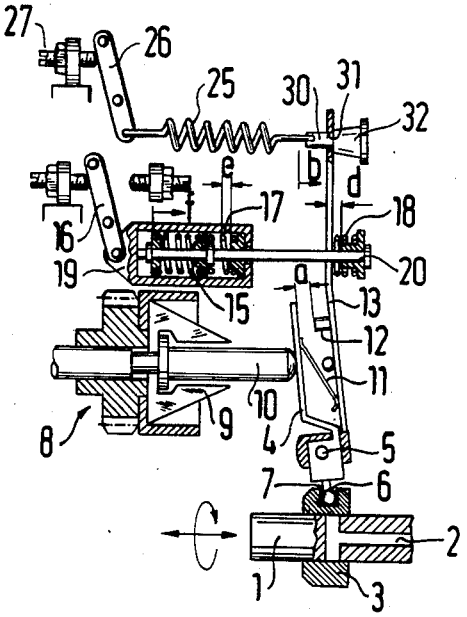
FIG. 1 shows generally in cross-section the first exemplary embodiment of the invention in schematic form.

In the first exemplary embodiment, shown in a very simplified form in FIG. 1, pump piston 1 of a fuel injection pump, which is preferably used to supply fuel to a self-igniting internal combustion engine used in motor vehicles, is set into simultaneously reciprocating and rotating motion by known means, but not shown herein. From the pump work chamber (not shown) defined by the pump piston, a T-shaped relief conduit 2 extending in the pump piston 1 leads to the surface of the pump piston 1 and is controlled there by an annular slide 3. As the pump piston 1 reciprocates, after a predetermined stroke length has been travelled this relief conduit 2 is opened up earlier or later depending on the position of the annular slide 3, thereby interrupting the injection. Thus the axial position of the annular slide 3 corresponds to the injected quantity.

The annular slide 3 is displaced by a starting lever 4, which is pivotable about a shaft 5 and with a tang 6 engages a groove 7 of the annular slide in order to actuate the annular slide. The other end of this starting lever 4 is engaged by an rpm signal transducer 8 which is driven at an rpm synchronized with the engine rpm, and which via flyweights 9 displaces an adjusting sleeve 10 which directly engages the starting lever 4. The starting lever 4 assumes the position shown prior to the starting of the engine; a starting spring 11 pushes the sleeve 10 into the outset position shown. In this position, the governor slide 3 assumes a position for an increased starting quantity. As soon as the engine is started, the flyweights 9 are moved apart and they pivot the starting lever 4 about the shaft 5, until after traveling the distance a the starting lever strikes a stop 12 of a tensioning lever 13, after which the increased quantity for starting is stopped by means of breakaway regulation.

The tensioning lever 13 is likewise pivotably supported on the shaft 5 and is loaded by a governor spring 15. By means of an adjusting lever 16, the adjustment or prestressing force which must be overcome in breakaway regulation of the rpm signal transducer can be varied. The position of the adjusting lever 16 corresponds to the particular load, or desired torque, imposed by the driver of the engine via the gas pedal of the vehicle. Disposed in series with this governor spring 15 are an adaptation spring 17 and an intermediate spring 18, the function of which will not be described in detail here. The governor spring 15 and the adaptation spring 17 have different degree of stiffness and they are disposed in the form of prestressed compression springs inside an adjustment cage 19, while the intermediate spring 18 is disposed directly between a coupling bolt 20 of the cage 19 and the tensioning lever 13. The governor spring 15 has a spring travel f, the adaptation spring 17 has a spring travel e and the intermediate spring 18 has a spring travel d.

The tensioning lever 13 is also engaged by an idling spring 25. This spring 25 is suspended at the end of a connecting bolt 30 which protrudes through a recess 31 in the tensioning lever 13 and has a head 32, acting as a stop, on its other end. The other end of the idling spring 25 is suspended in an adjusting element which is embodied here as an adjusting lever 26. The adjusting lever 26, in order to vary the prestressing of the idling spring, is adjustable by means of an adjusting screw 27, and it operates independently of and parallel to the other governor springs. For instance, if the adjusting lever 16 assumes the illustrated position and the engine drives the rpm signal transducer 8 at speeds above the idling rpm such that the starting spring 11 is compressed and the idling spring 25 is correspondingly prestressed, this effects an enduring injection quantity in that it keeps the governor slide 3 in the required position. As soon as the driver steps on the gas, that is, pivots the adjusting lever 16 out of the illustrated position, the governor slide 3 is displaced into a position for a larger injection quantity, without the engine's temporarily receiving no fuel in other words the engine does not go fuel-less for a fraction of a second. The primary result is that jerking or bucking is avoided in this transitional phase. Furthermore, the idling spring 25 can be extremely finely adjusted and it operates independently of the other governor springs.

Figure 2:
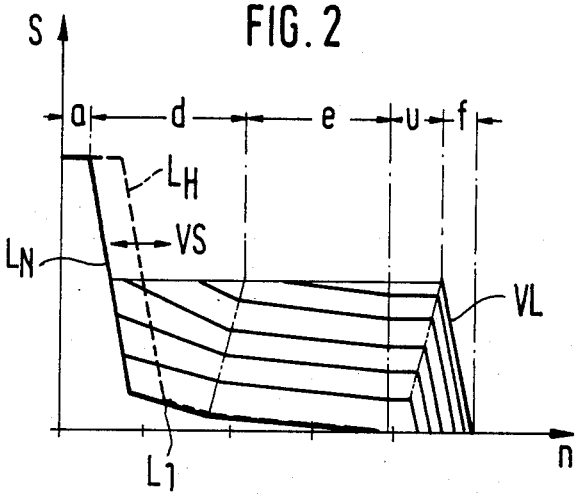
FIG. 2 is an rpm/travel function diagram in the governor according to the invention.

FIG. 2 is a function diagram of this rpm governor according to the invention, in which the rpm n is plotted on the abscissa and the travel s of the governor slide 3, in millimeters, is plotted on the ordinate. The zones a, d, e and f correspond to the governing distances, or travel, indicated for the various springs. Between the zones e and f is the zone u, which is an unregulated zone. This governor performance graph shown here corresponds to a minimum/maximum speed governor having partial-load adaptation. The partial-load adaptation is performed in the zone e, by adapting the injection quantity to the actual quantity that can be combusted. In the unregulated zone u, the governor curves again have a flat course, until the breakaway regulation is effected in zone f by means of the governor spring 15. These breakaway regulation curves have a correspondingly steep course. As is well known, the governor may operate either with or without an intermediate spring 18; the intermediate spring effects a wider idling range and a larger P-degree, corresponding to the zone d. The travel of the idling spring 25 is represented by the lowermost characteristic curve $L_H$ or $L_N$ or $L_1$, which passes through the zones d and e. Letter a identifies the starting zone, corresponding to the position $s_1$ of the governor slide 3 in which the characteristic curve A, up to approximately 200 rpm, is indicative of fuel being supplied at virtually twice the injection quantity.

For the characteristic curve L, the adjusting lever 16 assumes the position shown in FIG. 1, and for the characteristic curve VL, in zone f, it assumes the full-load position opposite this idling position. Particularly in the transition of the idling curve $L_n$ in the flatter zone $L_1$, a clear course of the idling curve is attained over a relatively wide range of tolerance. It is exactly in this range that the idling spring in known governors runs out; that is, it no longer effects any regulation of fuel quantity, thereby bringing about the above-mentioned "holes" in the transition from overrunning to loaded operation. The curve $L_1$ represents an injection pump setting for a lower idling rpm, and the curve $L_H$ shown in dashed lines beside it represents the setting for an increased idling rpm, with a correspondingly varied position of the adjusting lever 26.

Figure 3:
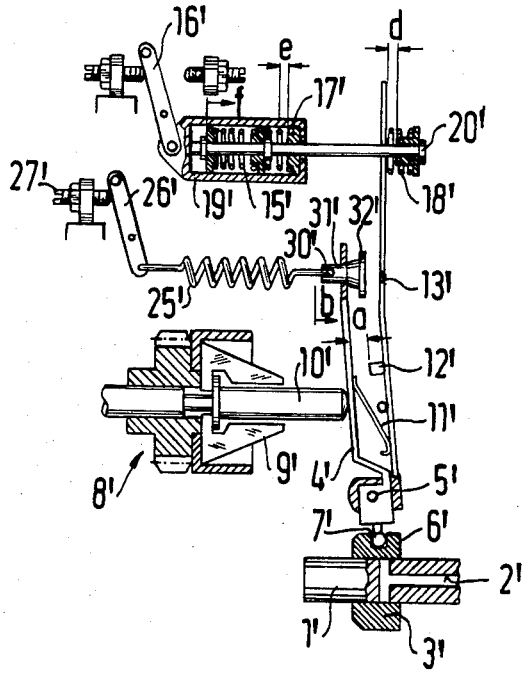
FIG. 3 shows generally also in cross-section the second exemplary embodiment.

In the second exemplary embodiment shown in FIG. 3, wherein the reference numerals correspond to those of FIG. 1, with a prime added and as distinguished from the first exemplary embodiment the idling spring 25′ engages the starting lever 4′, with the advantage of acting directly upon the governor slide 3′. What is important in this embodiment is that the governor spring 25′ no longer operates during starting, so that only the starting spring 11′ will displace the rpm signal transducer 8′ into the illustrated outset position, and so that after starting, solely in accordance with the starting spring 11′, the excess fuel quantity will be reduced correspondingly early, in order to prevent engine racing.

Figure 4:
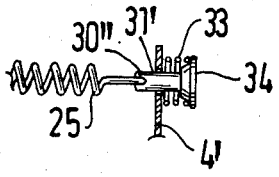
FIG. 4 shows the third exemplary embodiment, using a correcting spring.

A particularly advantageous further development of the exemplary embodiments of FIGS. 1 and 3 is the inclusion of a correcting spring 33 as shown in FIG. 4. In FIG. 4, all that is shown of the exemplary embodiments of FIGS. 1 and 3 is the connecting bolt 30, which is here marked as connecting bolt 30″. As in the previous exemplary embodiments, the idling spring 25 is suspended in the end of this bolt 30″. The bolt protrudes through a recess 31′ at the end of the starting lever 4″ and on its far end has a head, which is now embodied in the form of a spring support plate 34. The correcting spring 33 is fastened between the spring support plate 34 and the starting lever 4″ and is embodied as a compression spring, acting in the same direction as the idling spring 25, which is a tensile spring. If this feature is applied to the exemplary embodiment of FIG. 1, the aperture 31′ is located in the drag or tensioning lever 13 in a manner corresponding to the aperture 31 of FIG. 1. The connecting bolt, modified in accordance with the exemplary embodiment of FIG. 4, is then guided through this aperture. In a different embodiment, instead of the above disposition, the bolt could also be disposed in a corresponding manner with a correcting spring being fastened between the adjusting element 26 and the associated end of the idling spring.

Figure 5:
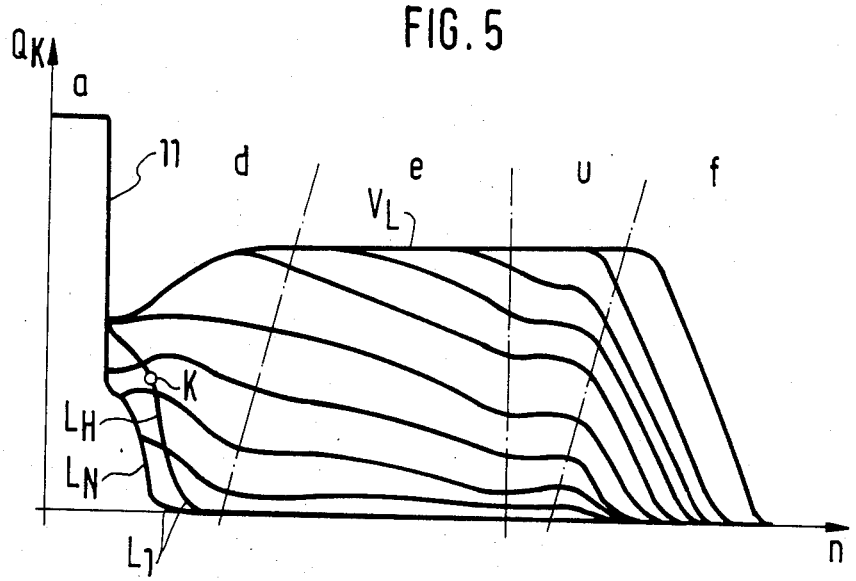
FIG. 5 is a schematic representation of the quantity/rpm diagram in accordance with a real performance graph for the exemplary embodiment of FIG. 3.

The mode of operation of this embodiment [of FIG. 4] will now be explained, referring to FIGS. 5 and 6:

FIG. 5 is a schematic representation of the quantity/rpm diagram, based on a real performance graph for an exemplary embodiment according to FIG. 3. It is laid out similarly to the diagram in FIG. 2, where the travel of the annular slide 3 is plotted over the rpm. The zones d, e, u and f are also found in this diagram. What is different here from FIG. 2 is the course of the curves $L_H$ and $L_N$. The diagram shows that at the end of the starting rpm, upon breakaway regulation toward the starting spring 11 the curve is very steep and extends virtually vertically. Upon attaining the full-load curve $V_L$, the idling spring comes into action, specifically earlier, at an increased idling $L_H'$ than at a lower idling $L_N$. Subsequently the curve loses its steepness but at a changing point K it again takes a steeper course, then finally, at the lower changing point, merges with the curve $L_1$ already known from FIG. 2, corresponding to the flatter course of the curve of the intermediate spring in zone d. At relatively low idling speed, the curve course is the same, but shifted toward lesser quantities $Q_K$. This kind of curve course, in which the idling point is in the zone of the steeper segment of the curves $L_H$ and $L_N$, has the disadvantage that if a load is imposed while idling, an unstable engine situation rapidly develops. Some examples of loads in the idling range are when power steering comes into play, or when a vehicle air conditioner is turned on. In such a case, because of the flatter curve course after point K, the rpm would collapse very rapidly, yet then the engine would enter the zone of the breakaway curve of the starting spring 11, and because of the steepness of this curve the engine would start to vibrate. The nonlinearity of the curve segments $L_N'$ and $L_H'$ can be traced to a nonlinear operation of a centrifugal rpm governor used in this case, which at such very low set idling speeds also has too little operating capacity. The effects of hysteresis also make themselves felt in this zone. Other tolerances and frictional effects, however, can also contribute to a curve course of this kind. For example, a differing adjustment characteristic of the governor in idling operation has a disadvantageous effect in this respect, if beyond a particular load range the injection rate is supposed to be decreased by having a portion of the supplied fuel quantity flow out during a portion of the pump piston supply stroke, bypassing the injection location; in order to attain the same injection quantity required for a given operating point, this necessitates a relatively large displacement of the annular slide in the direction of an increased quantity. The adjustment characteristic of the annular slide 3 is accordingly different during idling operation from that in partial-load and full-load operation.

Figure 6:
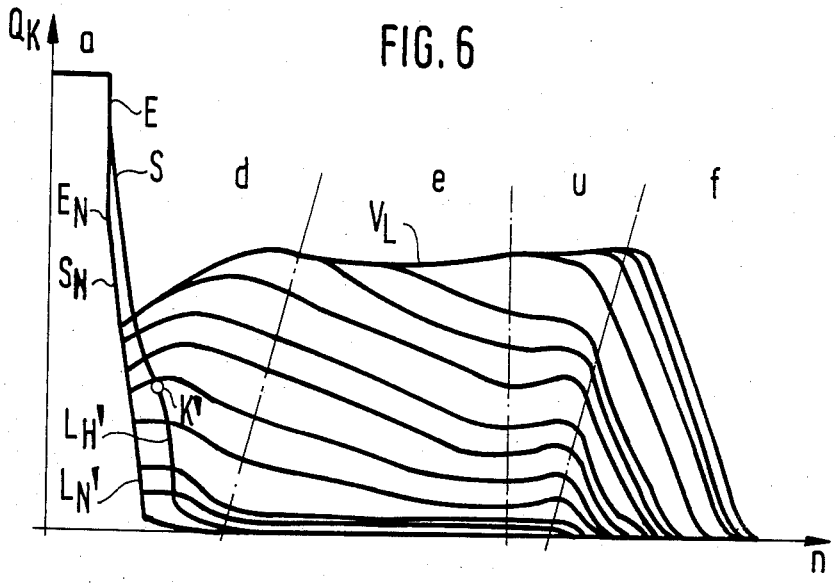
FIG. 6 is a quantity/rpm diagram according to a real performance graph for the exemplary embodiment of FIG. 4.

With the aid of the correcting spring, the curve course $L_N'$ and $L_H'$ can now be varied as shown in FIG. 6. In FIG. 6, again, the fuel quantity pumped by the fuel injection pump is plotted over the rpm, in an adaptation of a real performance graph. Deviating from FIG. 5, the influence of the correcting spring 33 of FIG. 4 becomes apparent here; it begins to effect breakaway regulation earlier than does the idling spring 25. Approximately in the area of the changing point K of FIG. 5, here marked K′, the operative travel distance of the correcting spring 33 has been fully used. The onset of operation of the correcting spring 33 is contrarily quite early, and it intersects with the original breakaway regulation curve of the starting spring, so that the resultant breakaway regulation curve S between the increased starting quantity and the attainment of the full-load curve $V_L$ has a flatter course, as compared with FIG. 5, after an onset point E. At point K′, this curve S makes a uniform transition to the curve $L_{H'}$ of the idling spring 25′ For lower idling, there is a corresponding curve $S_N$, beginning somewhat later, at $E_N$, which makes a uniform transition with the curve $L_{N'}$. In this manner, a good transition and stable idling are attained, while the idling rpm is kept at a very low level.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An rpm governor for fuel injection pumps, having a first pivotable lever, said first lever being engaged by an adjustable governor spring counter to a restoring force, said force being generated by an rpm signal transducer and transmitted via a pivotable second lever, whereby to adjust the injection quantity adjusting member of said fuel injection pump, to said first lever after said second lever has made contact with a stop of said first lever, an idling spring embodied as a tensile spring arranged to engage said first lever parallel to said governor spring and at least one starting spring disposed between said levers, said starting spring adapted to be stressed until said second lever rests on said first lever, a correcting spring disposed in series with said idling spring, said idling spring, further being articulated between two points, one of said points adapted to engage at least one of the said two levers and the other of said points being in a stationary but adjustable manner arranged to engage an adjusting element during operation of said fuel injection pump.

2. An rpm governor as defined by claim 1, further wherein said idling spring engages said second lever counter to the force of the rpm signal transducer.

3. An rpm governor as defined by claim 1, further wherein said idling spring has opposite end portions one end portion secured to a connecting element which penetrates at least one of said levers or adjusting element, a correcting spring beyond said lever and a stop means on said one end portion.

4. An rpm governor as defined by claim 1, further wherein an intermediate spring and an adaptation spring is disposed in series with said governor spring.

* * * * *